United States Patent [19]

Kissling et al.

[11] Patent Number: 4,604,101

[45] Date of Patent: Aug. 5, 1986

[54] AFTER TREATMENT OF ANIONIC DYEINGS, PRINTINGS AND OPTICAL BRIGHTENINGS ON TEXTIL FIBERS

[75] Inventors: Bruno Kissling, Hagendorf; Tibor Robinson, Basel, both of Switzerland

[73] Assignee: Sandoz Ltd., Basel, Switzerland

[21] Appl. No.: 703,699

[22] Filed: Feb. 21, 1985

[30] Foreign Application Priority Data

Feb. 24, 1984 [DE] Fed. Rep. of Germany ..... 3406631

[51] Int. Cl.[4] ..... D06L 3/12; D06M 15/54; D06P 1/39

[52] U.S. Cl. ..... 8/551; 8/531; 8/532; 8/534; 8/549; 8/556; 8/606; 8/648; 8/918

[58] Field of Search ..... 8/551, 556, 549, 606

[56] References Cited

U.S. PATENT DOCUMENTS

| | | | |
|---|---|---|---|
| 2,649,354 | 8/1953 | Hemmi et al. | 8/551 |
| 4,247,476 | 1/1981 | Haase et al. | 564/61 |
| 4,410,652 | 10/1983 | Robinson et al. | 8/496 |
| 4,436,524 | 3/1984 | Valenti | 8/551 |
| 4,439,203 | 3/1984 | Runyon et al. | 8/496 |
| 4,439,208 | 3/1984 | Moser et al. | 8/556 |
| 4,443,223 | 4/1984 | Kissling et al. | 8/496 |
| 4,452,606 | 6/1984 | van Diest et al. | 8/496 |
| 4,484,927 | 11/1984 | Valenti | 8/554 |
| 4,511,707 | 4/1985 | Runyon et al. | 8/496 |

FOREIGN PATENT DOCUMENTS 1546809 5/1979 United Kingdom .

OTHER PUBLICATIONS

Sandoz Technical Bulletin No. 1-309/77 on Sandofix ®TP Liquid.

*Primary Examiner*—A. Lionel Clingman
*Attorney, Agent, or Firm*—Gerald D. Sharkin; Richard E. Vila; Thomas C. Doyle

[57] ABSTRACT

Dyeings on hydroxy group- or nitrogen-containing fibres are improved by aftertreatment, simultaneously or sequentially, with (A) a polymeric reaction product of an amine with cyanamide, dicyandiamide, quanidine or bisguanidine and (B) a quaternary polyalkylene polyamine. A synergistic effect between (A) and (B) is observed.

19 Claims, No Drawings

AFTER TREATMENT OF ANIONIC DYEINGS, PRINTINGS AND OPTICAL BRIGHTENINGS ON TEXTILE FIBERS

The invention relates to the aftertreatment of dyed, printed or brightened textile fibres.

The present invention provides a process for the aftertreatment of hydroxy group- or nitrogen-containing textile fibres which have been dyed or printed with an anionic dyestuff or brightened with an anionic optical brightener comprising the step of treating the dyed, printed or brightened fibres, simultaneously or sequentially, with (A) a polymeric reaction product of a monofunctional or polyfunctional amine having one or more primary and/or secondary and/or tertiary amino groups with cyanamide, dicyandiamide, guanidine or bisguanidine in which up to 50 mole percent of the cyanamide, dicyandiamide, guanidine or bisguanidine may be replaced by a dicarboxylic acid or a mono- or di-ester thereof, said product (A) containing at least one free hydrogen atom linked to a nitrogen atom, and (B) a quaternary polyalkylene polyamine.

The textile fibres are preferably natural or regenerated cellulose or natural or synthetic polyamide, particularly cotton, viscose, wool, silk or nylon. The preferred substrates are of cotton alone or mixed with other natural or synthetic fibres for example wool, silk, nylon, cellulose $2\frac{1}{2}$-acetate or triacetate, viscose, polyester or polyacrylonitrile.

The aftertreatment process is preferably carried out by applying (A) and (B) simultaneously to the textile fibres. Products (A) and (B) are known individually as aftertreatment agents for dyed or printed textile fibres, but it has now been found that their simultaneous or sequential use has a synergistic effect by which fastness properties are improved to a greater extent than when comparable amounts of the individual components are used separately.

Preferably, for every 100 parts dry weight of product (B), 5–100 parts dry weight of product (A), more preferably 10–30 parts dry weight of product (A) are applied. It is preferred that (A) and (B) are in a physical mixture and are not brought together under conditions of temperature, pH, etc. such that they would chemically react with each other.

A particularly preferred aftertreatment process comprises application of a mixture of (A) and (B) in the above proportions from an aqueous exhaust bath at a temperature of 30°–70° C. and a pH value of 4–7, preferably 4–4.5, for a time of 10–30 minutes. Additional auxiliaries, for example softeners, wetting agents, water repellents, lubricants, agents to improve handle, etc. may also be present. The total amount of (A) and (B) to be used will depend primarily upon the depth of the dyeing to be aftertreated, but will normally be from 0.5% to 6% based on the dry weight of substrate. For a 1/1 standard depth dyeing, from 3% to 4% is preferred, and correspondingly more or less for deeper or lighter dyeings.

The product (A) is preferably the water-soluble reaction product of an amine of formula I $$R—NH—R \qquad \text{I}$$

or, preferably, a polyalkylene polyamine of formula II $$RRN\text{-}(Z—X)_n Z—NRR \qquad \text{II}$$

in which each

R independently is hydrogen or a $C_{1-10}$alkyl group unsubstituted or monosubstituted with hydroxy, $C_{1-4}$alkoxy or cyano, n is a number from 0 to 100

Z, or each Z independently when $n>0$, is $C_{2-4}$ alkylene or hydroxyalkylene and X, or each X independently when $n>1$, is —O—, —S— or —NR— where R is as defined above, provided that the amine of formula II contains at least one reactive —NH— or —$NH_2$ group, with cyanamide, dicyandiamide (DCDA), guanidine or bisguanidine.

More preferably each R in II is hydrogen, n is 0 to 4, X is NH or —$NCH_3$— and Z, or each Z independently when $n>0$, is $C_{2-4}$ alkylene. Particularly preferred compounds are diethylene triamine, triethylene tetramine, tetraethylene pentamine, 2-aminoethyl-3-aminopropylamine, dipropylene triamine and N,N-bis-(3-aminopropyl)methylamine.

Products A are known, and may be prepared by the methods described for example in British Pat. No. 657 753, U.S. Pat. No. 2,649,354 and U.S. Pat. No. 4,410,652. Suitably the amine, in free base or salt form, is reacted with the other starting material in the absence of water at elevated temperatures optionally in the presence of a non-aqueous solvent. Preferably the reaction is carried out in the absence of solvent at a temperature of 140°–160° C., and for most combinations of reagents, ammonia is evolved. The reagents are preferably reacted in a molar ratio of 0.1 to 1 mole of cyanamide, DCDA, guanidine or biguanidine per mole of reactive —NH or —$NH_2$ groups, and when DCDA is reacted with a polyalkylene polyamine, the molar ratio of the reactants is more preferably from 2:1 to 1:2, particularly about 1:1.

The products (A) are near-colourless viscous liquids or solids which are basic in character, water-soluble either in the free base or salt form, and contain reactive hydrogen atoms bonded to nitrogen.

Up to 50% mole, preferably up to 20% mole of the DCDA or other reagent to be reacted with the amine may be replaced by a dicarboxylic acid or a mono- or di-ester thereof. Suitable acids include adipic acid, oxalic acid and terephthalic acid, for example in the form of their dimethyl esters.

Particularly preferred products (A) are the reaction products of DCDA with diethylene triamine or triethylene tetramine.

The quaternary polyalkylene polyamine (B) is preferably a water-soluble reaction product of an N,N-tetraalkylalkylenediamine with a dihaloalkane, or of a secondary alkylamine with an epihalohydrin, particularly of a di($C_{1-4}$alkyl)amine with epichlorohydrin.

Preferred products B are polymers containing repeating units of formula III

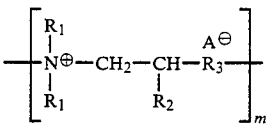

III in which each $R_1$ independently is $C_{1-4}$alkyl $R_2$ is H or OH $R_3$ is $-CH_2-$, $-CH_2-(CH_2)-$ or

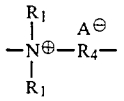

$R_4$ is $-CH_2CH_2OCH_2CH_2-$ or $-(CH_2)_b-$ m is a number from 7 to 75 b is a number from 1 to 5 and $A^{\ominus}$ is an anion of an inorganic or organic acid, e.g. chloride, sulphate, acetate, formate, phosphate or bisulphate.

Particularly preferred products B are polymers containing repeating units of formula IV

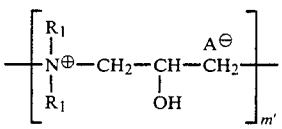

IV in which $A^{\ominus}$ and $R_1$ are defined above, and m' is a number from 20 to 30.

Preferably $R_1$ is methyl and m' is on average about 25. The full structure of product (B) having repeating units of formula IV is preferably of formula V

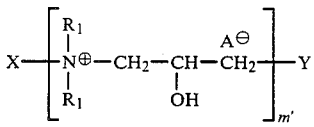

V in which $R_1$, $A^{\ominus}$ and m' are defined above,

X is H or

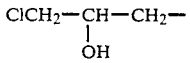

and

Y is —OH or

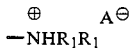

Products (B) are known and may be prepared according to known methods. For example when product (B) has repeating units of formula IV its preparation is described in British Pat. No. 1 396 195.

The textile substrate is dyed, printed or brightened by conventional methods. For hydroxy group-containing fibres, preferred anionic dyestuffs are direct dyes, particularly 1:1 or 1:2 metal complex direct dyes, or reactive dyes. Suitable dyes of these types are those listed in Colour Index as C.I. Direct Dyes and C.I. Reactive Dyes, particularly those which meet the criterion of the test method described in British Pat. No. 2 093 076.

Preferred reactive dyestuffs are those which contain 1-4 sulphonic acid or sulphonamide groups together with a mono-, di- or trihalopyrimidyl- or mono- or dihalotriazinyl group as the reactive group. The direct dyestuffs are preferably monoazo, polyazo, anthraquinone or phthalocyanine dyes containing from 1 to 4 water solubilizing groups such as sulphonic acid or sulphonamide groups. Suitable individual direct dyestuffs include those listed in U.S. Pat. No. 4,443,223.

For nitrogen-containing fibres, e.g. polyamides, preferred anionic dyes are mono- or polysulphonated wool or nylon dyes having a molecular weight of 400-1000, optionally in the form of metal complexes. More preferred dyes have at least two sulphonic acid groups and a molecular weight from 600-1000 or, in metal complex form, 800-1000.

A preferred group of dyestuffs are C.I. Acid Dyes which exhaust on to Nylon 6 to the extent of at least 50% from an aqueous bath containing twice the amount of dye required to give a 1/1 standard depth dyeing, at a goods-to-liquor ratio of 1:30, after 60 minutes at pH 3-11 and a temperature of 30°-98° C. Suitable acid dyes are disclosed in British Patent Application No. 2 125 834A.

Surprisingly, the simultaneous or sequential application of the stated amounts of products (A) and (B) to the dyed goods gives a synergistic effect. The fastness properties, particularly wet fastnesses, and also the handle and tear strength of goods comprising hydroxy group-containing fibres are improved significantly over those obtained using (A) or (B) alone. Furthermore the aftertreated dyeings contain no residual formaldehyde. The effect of the aftertreatment upon light fastness properties and change of shade is smaller then for conventional fixing agents which can liberate formaldehyde.

For simultaneous application, a stock mixture of (A) and (B) may be made by mixing the components in suitable proportions in the form of aqueous dispersions, and diluting the mixture with water to obtain a solution containing 20-50%, preferably 35-40% dry weight of active ingredients. Additional auxiliaries as described above may also be present.

The following Examples illustrate the invention. Temperatures are in degrees Centigrade, parts are by weight, and percentages given for components of dyebaths and aftertreatment baths are by weight of dry active ingredient based upon the dry weight of substrate.

PREPARATION OF AFTERTREATMENT AGENTS

Example (a)

80 Parts of a 50% wt. aqueous dispersion of the reaction product of epichlorohydrin and dimethylamine, prepared according to Example 1 of British Pat. No. 1 396 195 ($\alpha_1$) are mixed under constant stirring with 20 parts of a 50% aqueous solution of the reaction product of diethylene triamine and dicyandiamide prepared according to paragraphs 1 and 2 of Example 1 of U.S. Pat. No. 4,410,652 ($\beta_1$). A milky aqueous dispersion is obtained. The dispersion is warmed to 60° and water is added until a clear water-white solution of the mixture is obtained, containing 35-40% dry weight of active ingredients.

Example (b)

30 Parts of a 50% wt. aqueous dispersion of the reaction product of triethylenetetramine with dicyandiamide in sulphate form, prepared according to paragraph 1 of Example 2 of U.S. Pat. No. 4,410,652 ($\beta_2$) are mixed with 70 parts of the aqueous dispersion of the product ($\alpha_1$) above, and water is added at room temperature until a clear solution is obtained, containing 35–40% dry weight of active ingredients.

Use of aftertreatment agents

EXAMPLE 1

A cotton substrate is dyed in conventional manner with a dyebath containing 1.5% C.I. Direct Orange 107 and 15.0% sodium sulphate and the dyeing is rinsed with water and then aftertreated in an aqueous bath containing 1% of the product of example (a) at a goods-to-liquor ratio of 1:20 for 20 minutes at 60°–70°, cold rinsed and dried. The aftertreated dyeing showed improved fastness to water, perspiration and repeated washing.

The fastness properties are better than those obtained by aftertreatment with 1% of either product ($\alpha_1$) or product ($\beta_1$) alone.

EXAMPLE 2

Example 1 is repeated, carrying out the aftertreatment in the in the presence of a conventional softening agent based on the reaction product of a high molecular weight carboxylic acid with a polyalkylene polyamine. The same good fastness properties are obtained together with an improved soft handle.

EXAMPLE 3

A cotton substrate is dyed in conventional manner with 1.75% C.I. Direct Scarlet 95, rinsed and aftertreated for 30 minutes at 60° in an aqueous bath containing 2% of the product of Example (b) at a goods-to-liquor ratio of 1:20. The resulting wet fastness properties are superior to those obtained using 2% of either product ($\alpha_1$) or product ($\beta_2$) alone.

EXAMPLE 4

The handle of the product of Example 3 may be improved in the same way as described in Example 2.

EXAMPLES 5–8

Table I shows the substrates, dyeings and aftertreatments used for these Examples.

TABLE I

| Ex. No. | Sub-strate | Dyestuff identity | Dyestuff % | Fixing agent identity | Fixing agent % | Aftertreatment minutes | Aftertreatment °C. |
|---|---|---|---|---|---|---|---|
| 5 | cotton | C.I. Direct Brown 113 | 1.5 | (a) | 3 | 30 | 60 |
| 6 | viscose | C.I. Direct Violet 66 | 1.5 | (b) | 1.5 | 30 | 70 |
| 7 | cotton | C.I. Reactive Red 123 | 0.8 | (a) | 2 | 30 | 70 |
| 8 | cotton | C.I. Reactive Yellow 125 | 0.75 | (b) | 2 | 30 | 70 |

The reactive dyeings of Examples 7 and 8 were deliberately given an inadequate soaping step. Nevertheless the aftertreated dyeings had good wet fastness properties.

What is claimed is:

1. A process for the after-treatment of hydroxy group- or nitrogen-containing textile fibres which have been dyed or printed with an anionic dyestuff or brightened with an anionic optical brightener comprising the step of treating the dyed, printed or brightened fibres, simultaneously or sequentially, with (A) a polymeric reaction product of a monofunctional or polyfunctional amine having one or more primary and/or secondary and/or tertiary amino groups with cyanamide, dicyandiamide, guanidine or bisguanidine in which up to 50 mole percent of the cyanamide, dicyandiamide, guanidine or bisguanidine may be replaced by a dicarboxylic acid or a mono- or di-ester thereof, said product (A) containing at least one free hydrogen atom linked to a nitrogen atom, and (B) a quaternary polyalkylene polyamine which is a water-soluble reaction product of an N,N-tetraalkylalkylenediamine with a dihaloalkane, or of a secondary alkylamine with an epihalohydrin.

2. A process according to claim 1 in which, for every 100 parts dry weight of product (B), 5–100 parts by dry weight of product (A) are applied to the textile fibers.

3. A process according to claim 1 in which (A) and (B) are applied simultaneously to the textile fibres.

4. A process according to claim 3 in which a mixture containing per 100 parts (B), 5–100 parts (A) is applied to a substrate consisting of cotton alone or mixed with other natural or synthetic fibres from an aqueous exhaust bath at a temperature of 30°–70° C. and a pH value of 4–7 for a time of 10–30 minutes.

5. A process according to claim 1 in which product (A) is the water-soluble reaction product of an amine of formula I $$R—NH—R \qquad \text{I}$$

or a polyalkylene polyamine of formula II $$RRN\text{-}(Z—X)\text{-}_nZ—NRR \qquad \text{II}$$

in which each

R independently is hydrogen or a $C_{1-10}$alkyl group unsubstituted or monosubstituted with hydroxy, $C_{1-4}$alkoxy or cyano, n is a number from 0 to 100

Z, or each Z independently when $n>0$, is $C_{2-4}$ alkylene or hydroxyalkylene and X, or each X independently when $n>1$, is —O—, —S— or —NR— where R is as defined above, provided that the amine of formula II contains at least one reactive —NH— or —$NH_2$ group, with cyanamide, dicyandiamide, guanidine or bisguanidine.

6. A process according to claim 5 in which product (A) is the reaction product of dicyandiamide with diethylene triamine or triethylene tetramine.

7. A process according to claim 1 in which product (B) is a polymer containing repeating units of formula IV

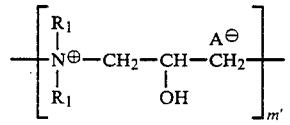

IV in which each $R_1$, independently, is $C_{1-4}$alkyl, $A^{\ominus}$ is an anion of an inorganic or organic acid, and m' is a number from 20 to 30.

8. A process according to claim 1 in which the anionic dyestuff is a reactive dyestuff containing 1–4 sulphonic acid or sulphonamide groups together with a mono-, di- or trihalopyrimidyl- or mono- or dihalotriazinyl group as the reactive group.

9. A process according to claim 1 in which a total of from 0.5% to 6% of (A)+(B) is applied, based on weight of active substance as a percentage of dry weight of substrate.

10. An aqueous aftertreatment composition comprising 20–50%, dry weight, of a mixture of (A) a polymeric reaction product of a monofunctional or polyfunctional amine having one or more primary and/or secondary and/or tertiary amino groups with cyanamide, dicyandiamide, guanidine or bisguanidine in which up to 50 mole percent of the cyanamide, dicyandiamide, guanidine or bisguanidine may be replaced by a dicarboxylic acid or a mono- or di-ester thereof, said product (A) containing at least one free hydrogen atom linked to a nitrogen atom, and (B) a quaternary polyalkylene polyamine which is a water-soluble reaction product of a N,N-tetraalkylalkylenediamine with a dihaloalkane, or of a secondary alkylamine with an epihalohydrin in the proportion, by weight, of 5–100 parts (A) to 100 parts (B), said composition further containing at least one softener, wetting agent, water repellant, lubricant or agent to improve handle.

11. A process according to claim 5 wherein (B) is a polymer containing repeating units of formula III

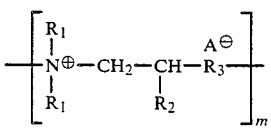

III in which each $R_1$ independently is $C_{1-4}$alkyl $R_2$ is H or OH $R_3$ is $—CH_2—$, $—CH_2—CH_2—$ or

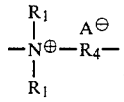

$R_4$ is $—CH_2CH_2OCH_2CH_2—$ or $-(CH_2)_b-$ m is a number from 7 to 75 b is a number from 1 to 5 and $A^{\ominus}$ is an anion of an inorganic or organic acid.

12. A process according to claim 7 wherein (A) is the reaction product of dicyandiamide with diethylene triamine or triethylene tetramine.

13. A process according to claim 11 wherein (A) is the product of reacting 0.1 to 1 mole of cyanamide, dicyandiamide, guanidine or biguanidine per mole of reactive —NH or $—NH_2$ groups in the amine of formula I or II.

14. A process according to claim 12 wherein (A) is the product of reacting dicyandiamide with diethylene triamine or triethylene tetramine in a mol ratio of 2:1 to 1:2.

15. A process according to claim 13 wherein (A) is the product of reacting cyanamide, dicyandiamide, guanidine or biguanidine with an amine of formula II in which each R is hydrogen, n is 0 to 4, X is —NH— or $—NCH_3—$ and Z, or each Z independently when $n>0$, is $C_{2-4}$alkylene.

16. A process according to claim 14 wherein a mixture containing, per 100 parts dry weight of (A), 5–100 parts dry weight of (B) is applied to the textile fibres in a total amount of from 0.5 to 6% based on the dry weight of the substrate.

17. A process according to claim 15 wherein a mixture containing, per 100 parts dry weight of (A), 5–100 parts dry weight of (B) is applied to the textile fibres in a total amount of from 0.5 to 6% based on the dry weight of the substrate.

18. A process according to claim 16 wherein the mixture of (A) and (B) is applied to a substrate which consists of cotton fibres and which has been dyed or printed with a direct or a reactive dyestuff.

19. A process according to claim 17 wherein the mixture of (A) and (B) is applied to a substrate which consists of cotton fibres and which has been dyed or printed with a direct or a reactive dyestuff.

* * * * *